US008559599B2

(12) United States Patent
Lee et al.

(10) Patent No.: US 8,559,599 B2
(45) Date of Patent: Oct. 15, 2013

(54) X-RAY GENERATION DEVICE AND CATHODE THEREOF

(75) Inventors: Pu-Jen Lee, Taipei County (TW); Wen-How Lan, Chiayi (TW)

(73) Assignees: Energy Resources International Co., Ltd., Taipei (TW); Suk-Yue Ka, Taipei (TW)

( * ) Notice: Subject to any disclaimer, the term of this patent is extended or adjusted under 35 U.S.C. 154(b) by 401 days.

(21) Appl. No.: 12/700,090

(22) Filed: Feb. 4, 2010

(65) Prior Publication Data

US 2011/0188634 A1 Aug. 4, 2011

(51) Int. Cl.
*H01J 35/06* (2006.01)

(52) U.S. Cl.
USPC ..... 378/134; 378/122; 378/136

(58) Field of Classification Search
USPC ..... 378/134, 136, 138, 122
See application file for complete search history.

(56) References Cited

U.S. PATENT DOCUMENTS

| | | | | |
|---|---|---|---|---|
| 3,846,006 | A * | 11/1974 | Atlee et al. | 445/28 |
| 4,730,353 | A * | 3/1988 | Ono et al. | 378/138 |
| 6,239,549 | B1 * | 5/2001 | Laprade | 313/533 |
| 6,438,207 | B1 * | 8/2002 | Chidester et al. | 378/138 |
| 6,477,233 | B1 * | 11/2002 | Ribbing et al. | 378/136 |
| 6,477,235 | B2 * | 11/2002 | Chornenky et al. | 378/143 |
| 6,553,096 | B1 * | 4/2003 | Zhou et al. | 378/122 |
| 7,924,983 | B2 * | 4/2011 | Moore | 378/136 |
| 8,081,734 | B2 * | 12/2011 | Elam et al. | 378/121 |
| 2003/0002627 | A1 * | 1/2003 | Espinosa et al. | 378/136 |
| 2005/0213709 | A1 * | 9/2005 | Dinsmore et al. | 378/119 |
| 2007/0189459 | A1 * | 8/2007 | Eaton et al. | 378/143 |
| 2010/0189223 | A1 * | 7/2010 | Eaton et al. | 378/68 |
| 2011/0188634 | A1 * | 8/2011 | Lee et al. | 378/122 |

* cited by examiner

*Primary Examiner* — Thomas R Artman
(74) *Attorney, Agent, or Firm* — Shimokaji & Associates P.C.

(57) ABSTRACT

An x-ray generation device and a cathode thereof are provided. The x-ray generation device comprises the cathode, a focusing device, an anode target, and a glass container. The cathode comprises a container and an electron beam generator. The container has a base and a side wall surrounding the base, and both of them define a trench. The electron beam generator comprises at least one metal unit, each of the at least one metal unit is chemical-vapor-deposited a carbon layer, and each of the at least one metal unit is disposed on a bottom of the trench. The at least one metal unit is electrically connected to an outer metal unit of the x-ray generation device. The glass container contains the cathode, the focusing device, and the anode target in sequence. Each of the at least one carbon layer faces the anode target. The glass container has a valve for evacuating and a window for emitting an x-ray.

10 Claims, 10 Drawing Sheets

The operation voltage (at 1mA) with different cathode-anode distance

X-RAY GENERATION DEVICE AND CATHODE THEREOF

BACKGROUND OF THE INVENTION

1. Field of the Invention

The present invention relates to an x-ray generation device and a cathode thereof. More particularly, an x-ray generation device and a cathode thereof of the present invention comprise an electron beam generator having at least one metal unit being chemical-vapor-deposited a carbon layer in the form of multiple-walls.

2. Descriptions of the Related Art

An x-ray generation device generates field emission electrons according to quantum theory of field electron emission. The basic principle of the field emission electrons is that the electrons of a conductor must have sufficient energy to get a chance to cross the potential energy barrier to the vacuum side when no electric field is applied. When an electric field is applied, the energy band is bent so electrons can cross the potential energy barrier to the vacuum side without huge amount of energy. When the applied electric field is increasing, the potential energy barrier to be crossed by electrons is decreasing and the strength of the derived current is increasing. According to electromagnetic theory, a sharp end of an object accumulates more electric charges than a blunt end of the object does. That is, a sharp end of an object has a higher electric field than an blunt end of the object does. Therefore, the electronic emitting part of a field emission cathode (i.e. x-ray generation device) is designed in the sharp form so that stronger electric field can be derived without applying high voltage.

At present time, an x-ray generation device usually serves as an electron source within a microwave element, sensor, panel display, or the like. The efficiency of electron emission mostly depends on the element structure, material, and shape of a field emission cathode (i.e. an x-ray generation device). A field emission cathode is made of metal, such as silicon, diamond, and carbon nano tube. Among these materials, carbon nano tube is particularly important because its openings are extremely thin and stable, it has low conducted field and high emitting current density, and it is highly stable. With these characteristics, carbon nano tube is extremely suitable for a field emission cathode. Therefore, it is highly possible that carbon nano tube will replace other materials and becomes the material of field emission in the next generation.

Field emission cathode can serve as a cathode of an x-ray generation device, such as an x-ray tube. An x-ray generation device encapsulates a cathode, electromagnetic-lens aperture, and an anode target within a glass container. The conventional thermionic cathode neon tube can be replaced by the carbon nano tube. When using a thermionic cathode neon tube in an x-ray generation device, around 99% of electricity is transformed to heat. Thus, the thermionic cathode neon tube must be cool down by cooling water. On the contrary, carbon nano tube can emit electron beams under smaller electric field intensity, so the efficiency of transferring electricity to electronic beams is higher than that of thermionic cathode nano tube. In addition, cooling process is not required when using carbon nano tube in an x-ray generation device.

The U.S. Pat. No. 6,553,096 presented by Zhou et al. discloses an x-ray generation device adopting carbon nano tube. Zhou et al. use materials with nanometer structures as an emitting source of a cathode field emission. Furthermore, Zhou et al. claim that 4 A/cm$^2$ of current density can be achieved.

The technique disclosed by Zhou et al. has to firstly purify carbon nano tubes by strong acid to make carbon nano tubes being shorter than 0.5 micrometer and being in the form of single-wall. Then, the carbon nano tubes are deposited on a substrate. The advantage is that the carbon nano tubes do not have to be fixed on the substrate by adhesive. In order to generate 10 mA/cm$^2$ of current density, 2.4 V/um to 5 V/um of starting voltage is required by the technique disclosed by Zhou et al. When a higher current density, such as 100 mA/cm$^2$ is required, the electric field has to be increased to 4 V/um to 7 V/um.

Zhou et al. asserts that the starting voltage required by their field emission cathode (which uses carbon nano tube in cathode) is much smaller than that required by conventional field emission cathodes (which require 50 V/um to 100 V/um of starting voltage and has MO or silicon sharp end). A field emission cathode using the material of graphite powder requires 10 V/um to 20 V/um of starting voltage, which is also beaten by the technique Zhou et al. Although field emission cathode using nano diamond can lower the starting voltage to 3-5 V/um, it is unstable when the current density is above 30 mA/cm$^2$.

Actually, the technique disclosed by Zhou et al. is very complicated. First, the graphite powder being the major material is added 0.6 atomic percent of nickel and/or 0.6 atomic percent of cobalt, and then they are placed into a quartz diode, wherein the added nickel and/or cobalt are the activator. The quartz diode is then heated up to 1150° C. The quartz diode is vacuumed and further injected with inert gases to maintain the pressure at 800 torr. Afterwards, the quartz is burned by Nd:YAG laser and then injected with inert gases again to let nano carbon be deposited on the inner wall of the quartz diode. At this time, the volume ratio of the derived signal wall nano tube is 50-70%. Thereafter, a purifying process, such as 20% H2O2, is required. The diameter of one single carbon nano tube is approximately 1.3-1.6 nm. The diameter of a bunch of carbon nano tubes is about 10-40 nm. Alternatively, the purifying process can use sulfuric acid and nitric acid with volume ration of 3:1. The length of the carbon nano tube is approximately 500 nm. In addition to the aforementioned processes, a series of deposition and lithography process to form the cathode is still required.

According to the aforementioned descriptions, an x-ray generation device and a cathode thereof having lower starting voltage is always preferred. Although carbon nano tube can achieve better performance and efficiency, the technique provided by Zhou et al is extremely complicated. Consequently, a simpler process to make an x-ray generation device and the cathode thereof is still in an urgent need.

SUMMARY OF THE INVENTION

An objective of the present invention is to provide an x-ray generation device. The x-ray generation device comprises a cathode, a focusing device, an anode target, and a glass container. The glass container contains the cathode, the focusing device, and the anode target in sequence. The cathode comprises a container and an electron beam generator. The container has a base and a side wall surrounding the base, wherein the base and the side ball define a trench. The electron beam generator comprises at least one metal unit. The at least one metal unit is chemical-vapor-deposited a carbon layer and is disposed on a bottom of the trench. The at least one metal unit is electrically connected to an outer metal unit of the x-ray generation device. Each of the at least one carbon layer faces the anode target. The glass container has a valve for evacuating and a window for emitting an x-ray.

Another objective of the present invention is to provide a cathode for use in an x-ray generation device. The cathode comprises a container and an electron beam generator. The container has a base and a side wall surrounding the base, wherein the base and the side wall define a trench. The electron beam generator comprises at least one metal unit. Each of the at least one metal unit is chemical-vapor-deposited a carbon layer. Each of the at least one metal unit is deposited on a bottom of the trench. The at least one metal unit is electrically connected to a outer metal unit of the x-ray generation device.

A further objective of the present invention is to provide an x-ray generation device. The x-ray generation device comprises a cathode, an anode target, and a glass container. The cathode comprises a container and an electron beam generator. The container has a base and a side wall surrounding the base, wherein the base and the side wall define a trench. A breach is formed at the top surface of the container and an inner side of the side wall. The electron beam generator comprises at least one metal unit. Each of the at least one metal unit is chemical-vapor-deposited a carbon layer. Each of the at least one metal unit is disposed on a bottom of the trench. The at least one metal unit is electrically connected to an outer metal unit of the x-ray generation device. The glass container contains the cathodes and the anode target in sequence. Each of the at least one carbon layer faces the anode target. The glass container has a valve for evacuating and a window for emitting an x-ray.

By having each of the metal units being chemical-vapor-deposited a carbon layer, the x-ray generation device and the cathode thereof of the present invention outperform those in the prior art in terms of starting voltage and operating voltage. Particularly, the x-ray generation device and the cathode thereof of the present invention can have better performance when the carbon layers are directly grown on the metal units and in the form of multiple-walls.

The detailed technology and preferred embodiments implemented for the subject invention are described in the following paragraphs accompanying the appended drawings for people skilled in this field to well appreciate the features of the claimed invention.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DESCRIPTION OF THE PREFERRED EMBODIMENT

The present invention provides an x-ray generation device and a cathode thereof. Particularly, the x-ray generation device and the cathode thereof of the present invention having the metal units of their electron beam generator being chemical-vapor-deposited carbon layers. Particularly, the carbon layers are directly grown on the metal units and an image of the carbon layers is in the form of multiple-wall. The following descriptions and embodiments are presented to enable one of ordinary skill in the art to make and use the present invention. However, these embodiments are not intended to limit the present invention to any specific environment, applications or particular implementations described in these embodiments. Therefore, description of these embodiments is only for purpose of illustration rather than to limit the present invention.

Figure 1A:
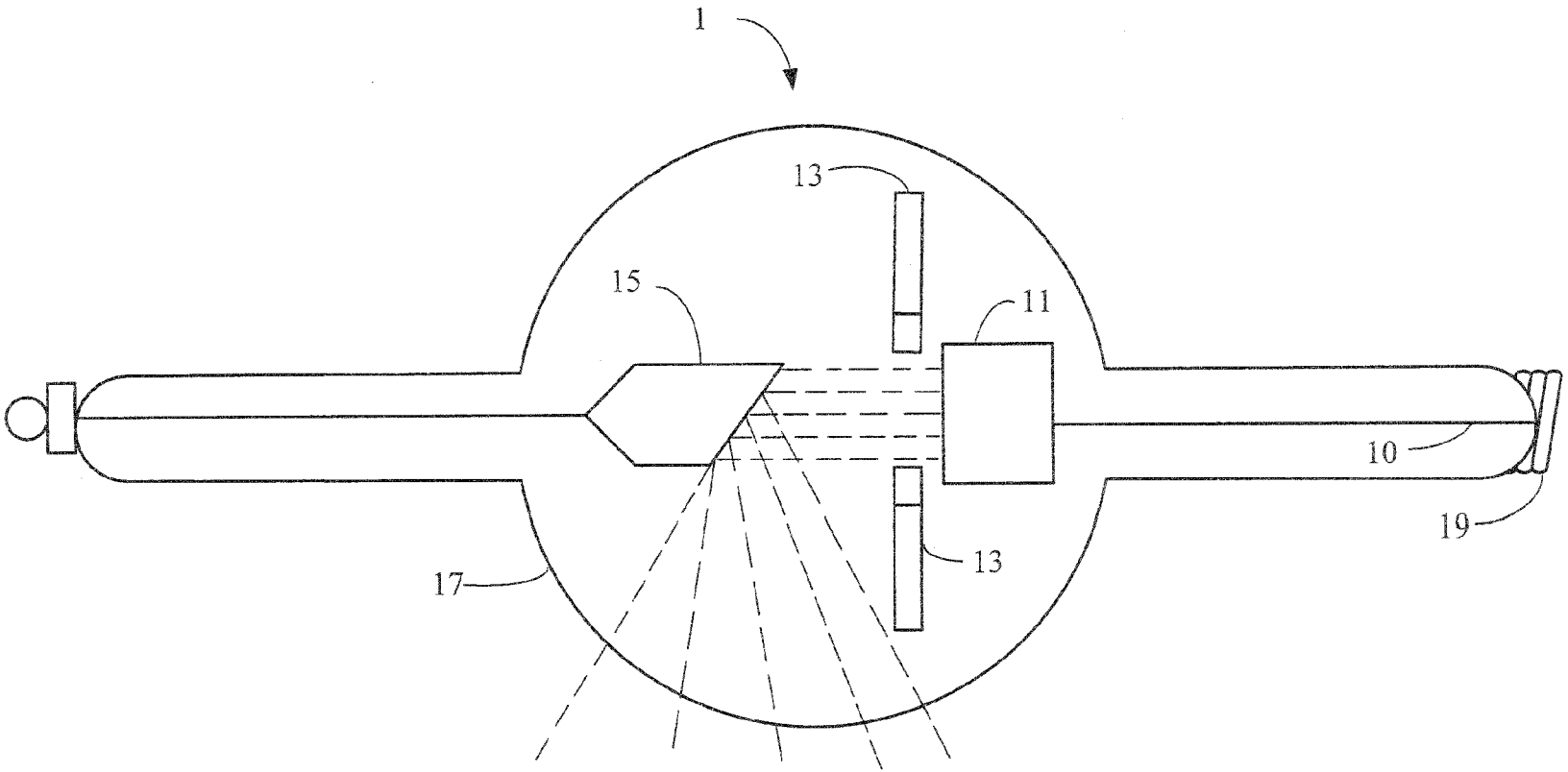
FIG. 1A illustrates a perspective view of an x-ray generation device of the first embodiment.

A first embodiment of the present invention is an x-ray generation device 1, whose perspective view is drawn in FIG. 1A. The x-ray generation device 1 comprises a cathode 11, a focusing device 13, an anode target 15, a glass container 17, and an outer metal unit 19. The glass container 17 contains the cathode 11, the focusing device 13, and the anode target 15 in sequence. In this embodiment, the focusing device 13 may be an electromagnetic lens or the like. The glass container 17 has a valve and a window, wherein the valve is for evacuating and the window is for emitting an x-ray. The vacuum negative pressure of the glass container 17 is between 1E-7 and 1E-8 torr.

Figure 1B:
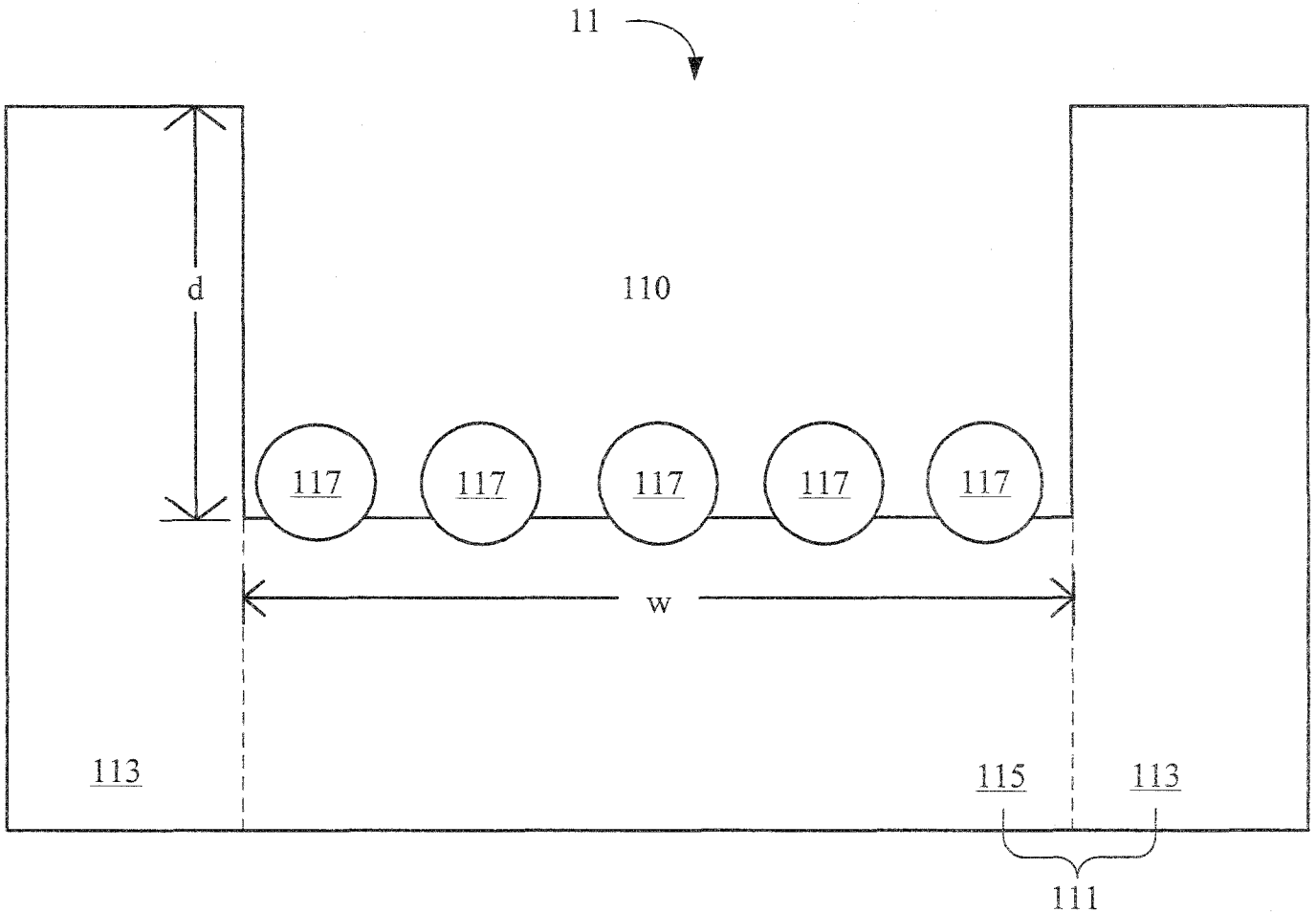
FIG. 1B illustrates a sectional drawing of the cathode of the x-ray generation device of the first embodiment.

FIG. 1B is a sectional drawing of the cathode 11. The cathode 11 comprises a container 111 and an electronic beam generator. The container 111 is made of metal and has a base 115 and a side wall 113. Particularly, the base 115 is formed as the bottom of the container 111, while the side wall 113 surrounds the base 115 and serves as the wall of the container 111. The base 115 may be a cylindrical base or may be in other shapes. The base 115 and side wall 113 define a trench 110. Particularly, when a depth d of the trench 110 is between 5 mm to 10 mm and a width w of the trench 110 is between 2 mm and 6 mm, the trench 110 favors the x-ray generation device 1.

The electron beam generator 1 comprises a plurality of metal units 117. Each of the metal units 117 is chemical-vapor-deposited a carbon layer. In addition, each of the metal units 117 is disposed on a bottom of the trench 110 in a way that each of the metal units 117 faces the anode target. Here, each of metal units 117 is a metal bar, wherein a diameter of each of the metal bars may be between 0.1 mm and 3 mm and a length of each of the metal bar may be 20 mm. It is noted that the present invention does not restrict the number of the metal units 117 and the shape of each of the metal units 117. For example, an electron beam generator of another embodiment may comprise only one single metal unit, and the metal unit may be a metal plate. In that case, the metal plate may be rectangle, a width of the metal plate is 2 cm, and a length of the metal plates is 3 cm. Yet another example is that an electron beam generator of yet another embodiment may comprise one single metal unit, and the metal unit is a metal spiral.

Furthermore, each of the metal units 117 may be fixed on the bottom of the trench 110 by one of a silver paste and a solder paste. The material of each of the metal units 117 is one of the nickel, tungsten, and cobalt. The metal units 117 are electrically connected to the outer metal unit 19 of the x-ray generation device 1 so that the cathode 11 is able to play the role of cathode when electricity is applied. Specifically, since both metal units 117 and the container 111 are made of metal, the metal units 117 are electrically connected to the outer metal unit 19 by having a metal wire 10 connecting the container 111 of the cathode 11 with the outer metal unit 19 as shown in FIG. 1A.

Figure 1C:
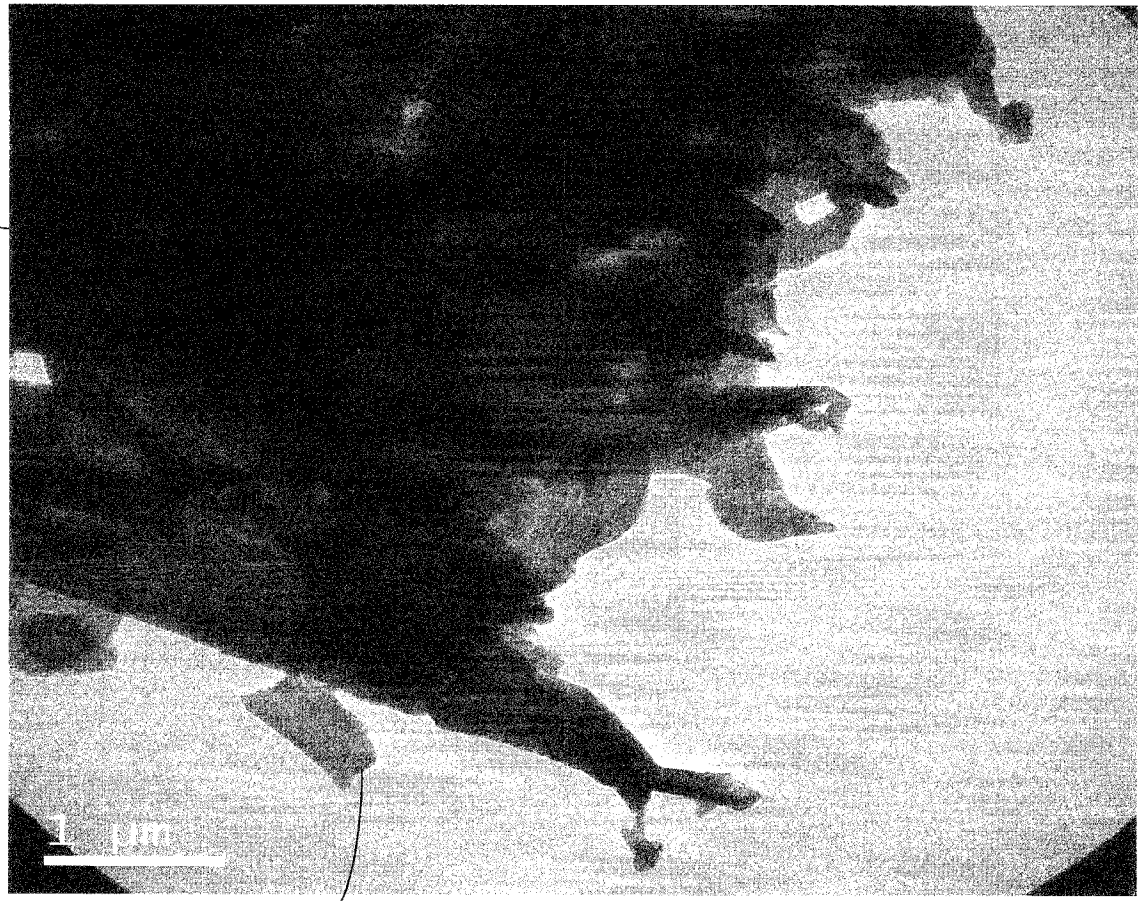
FIG. 1C shows an image of a carbon layer from an electron microscope.

As mentioned, each of the metal units 117 is chemical-vapor-deposited a carbon layer. FIG. 1C shows an image of a carbon layer from an electron microscope, and it can be seen that the image of the carbon layer is in the form of multiple-walls. Furthermore, the carbon layer of each of the metal units 117 is directly grown on the metal units 117 in an chemical-vapor-deposition process. A carbon layer is then deposited on each of the metal units 117 by CVD (chemical-vapor-deposition). A thickness of each of the inter layers is between 10 nm and 60 nm, while a thickness of each of the emission layers is between 1 nm and 50 nm. In FIG. 1C, the light grey part 117*a* is an exemplary image of the emission layer, while the dark grey part 117*b* is an exemplary image of the inter layer.

Figure 1D:
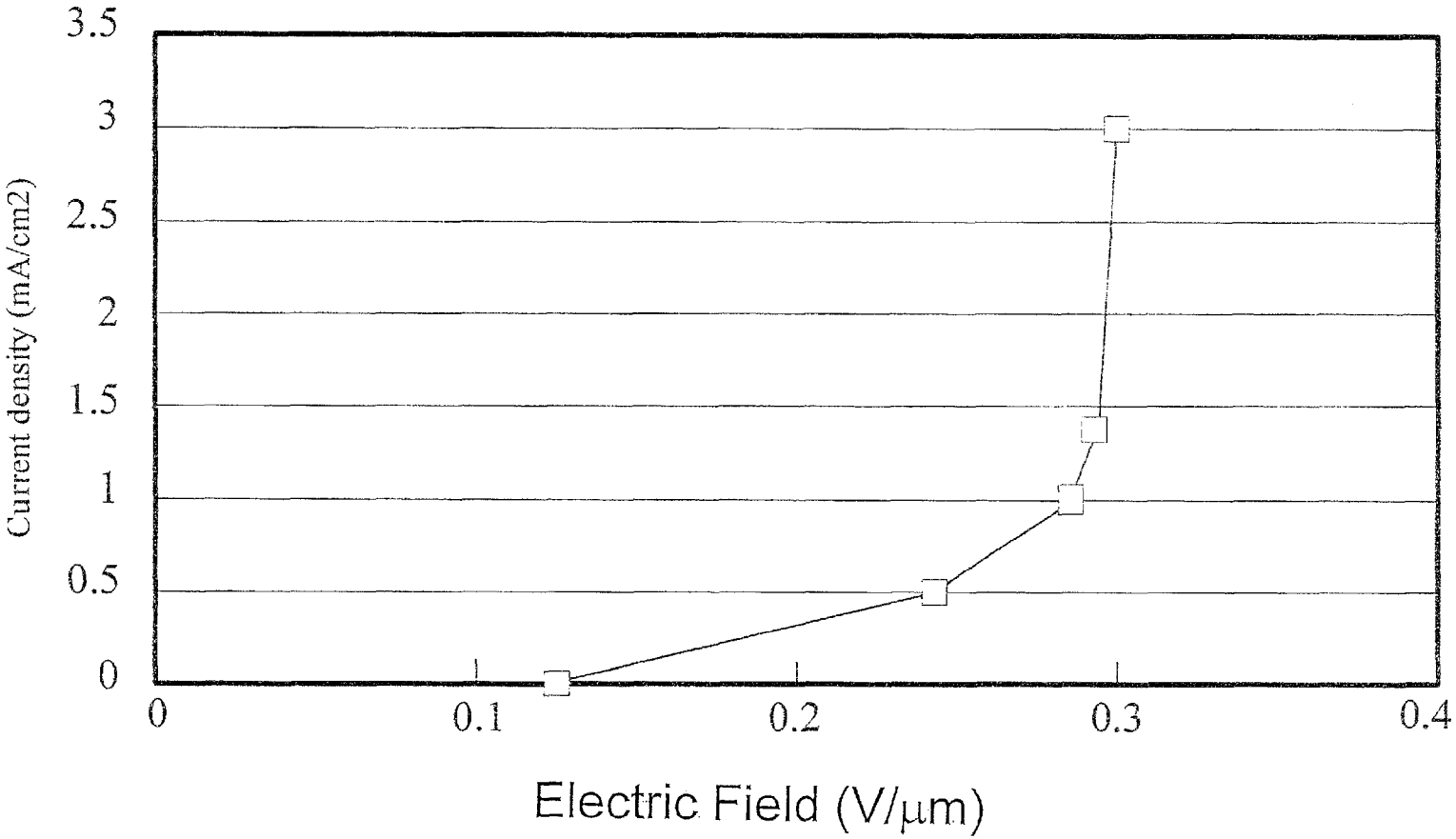
FIG. 1D illustrates a diagram of a starting voltage and a current density of the x-ray generation device of the first embodiment.

FIG. 1D illustrates a diagram of a dependence of the current density on the electric field of the x-ray generation device 1. When the electric field reaches 0.3 V/μm, the current density of each of the metal units 117 is 1 mA/cm$^2$. The electric field 0.3 V/um is herein called a starting field of the x-ray generation device 1. Since an x-ray generation device in the prior art requires a starting field of at least 2 V/μm, the x-ray generation device of the present invention outperforms that in the prior art in terms of starting field. When the field applied to the x-ray generation device 1 is above the starting field, the electron beam generator generates x-rays. The x-rays are focused by the focusing device 13 and then reflected by the anode target 15.

Figure 1E:
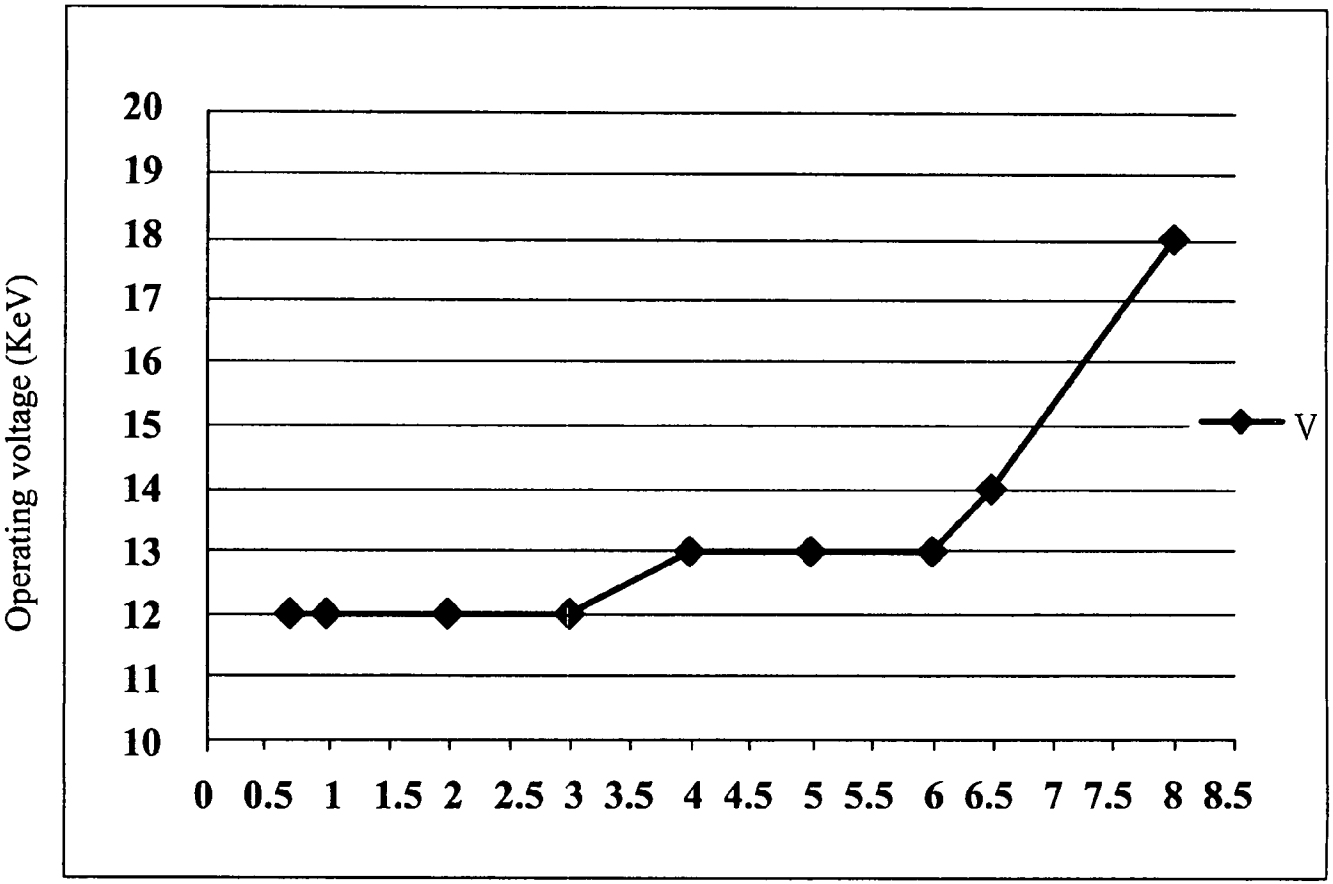
FIG. 1E illustrates a simulation result of an operating voltage of the x-ray generation device of the first embodiment.

FIG. 1E illustrates a simulation result of an operating voltage (at 1 mA) with different cathode-anode distance of the x-ray generation device 1. When a distance between each of the carbon layers and the anode target 15 is between of 0.7 cm and 3 cm, the operating voltage of the x-ray generation device 1 is 12 KeV. The operating voltage of the x-ray generation device 1 is between 12 and 13 keV when the distance between each of the carbon layers and the anode target 15 is between 0.7 cm and 6 cm. It is clearly that the operating voltage of the x-ray generation device 1 is very stable and low when the distance between the each of the carbon layers and the anode target 15 is between 0.7 cm and 6 cm.

By having each of the metal units chemical-vapor-deposited a carbon layer, the x-ray generation device 1 outperforms those in the prior art in terms of starting voltage and operating voltage. Particularly, the x-ray generation device 1 can have better performance when the carbon layers are directly grown on the metal units 117 and in the form of multiple-walls.

Figure 2:
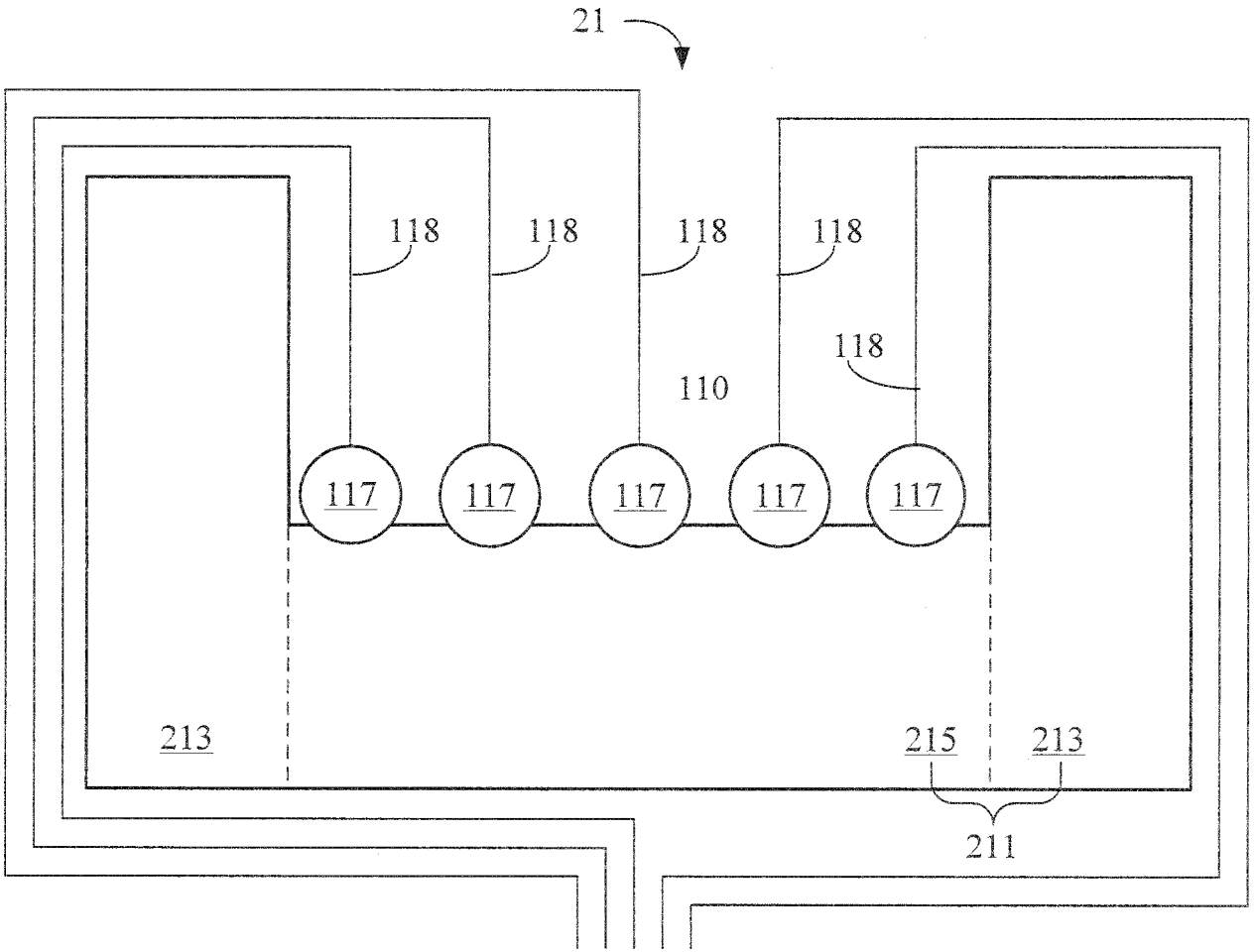
FIG. 2 illustrates a cathode of the second embodiment.

A second embodiment of the present invention is a cathode 21, whose sectional drawing is shown in FIG. 2. The cathode 21 of the second embodiment can replace the cathode 11 of the first embodiment and cooperate with the focusing device 13, the anode target 15, the glass container 17, and the outer metal unit 19. The cathode 21 comprises a container 211 and an electron beam generator. The electron beam generator of the cathode 21 is similar to that of the cathode 11 in the first embodiment. In addition, the electron beam generator of the cathode 21 has many variations as those of the cathode 11. As the details are described in the first embodiment, they are not repeated here. The following descriptions are focused on the differences between the cathode 21 and the cathode 11.

The container 211 has a base 215 and a side wall 213 surrounding the base 215. The base 215 and the side wall 213 define the trench 110. It is emphasized that the base 215 and the side wall 213 are made of nonmetal. Therefore, to have the metal units 117 electrically connected to the outer metal unit 19 of the x-ray generation device 1, the cathode 21 comprises a plurality of metal wires 118, wherein each of the metal wires 118 is connected to one of the metal units 117 at one end and is connected to the outer metal unit 19 at the other end.

When the cathode 21 of the second embodiment replaces the cathode 11 of the x-ray generation device 1, the replaced x-ray generation device also have the similar performances and advantages as the x-ray generation device 1.

Figure 3A:
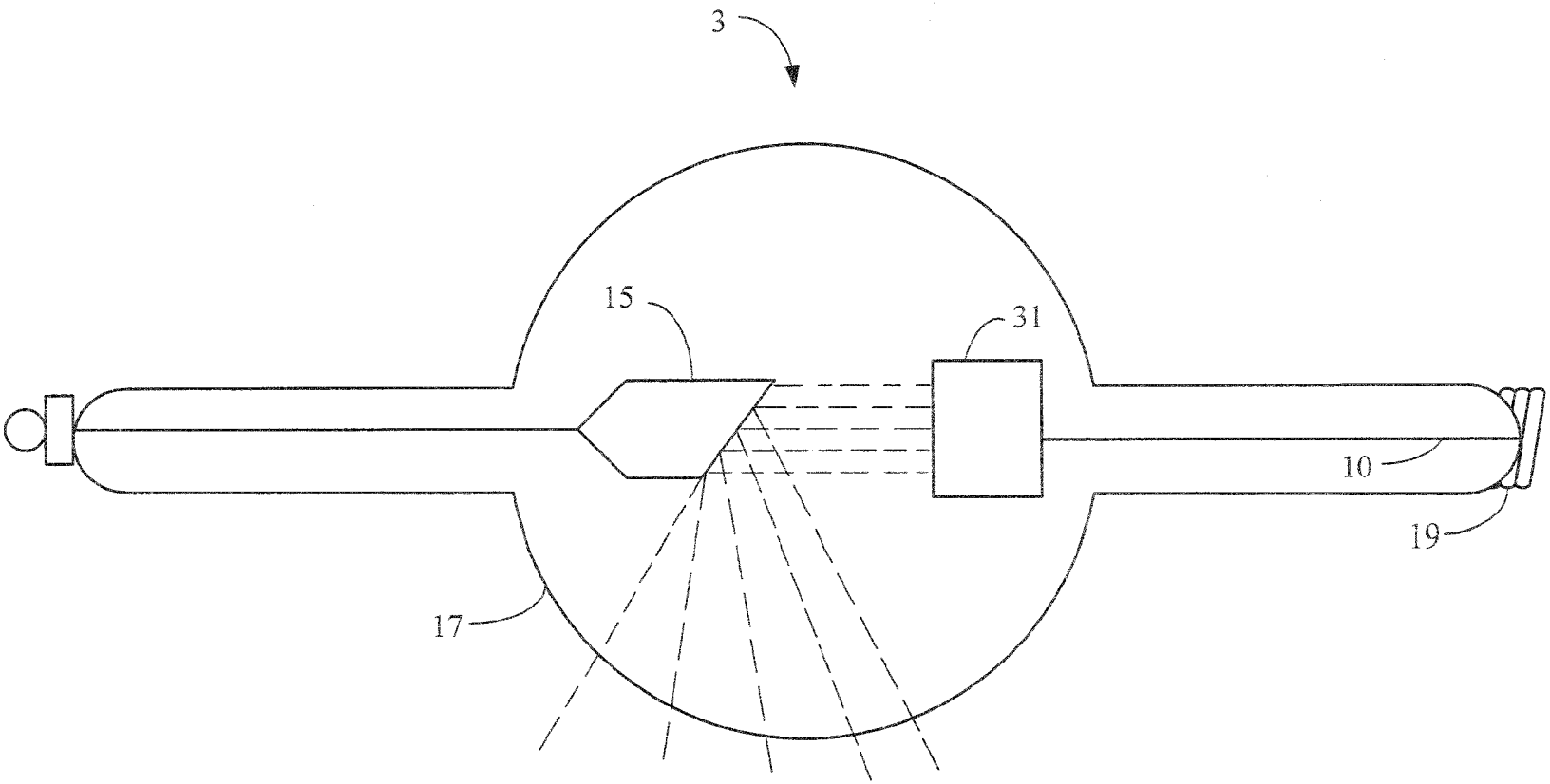
FIG. 3A illustrates a perspective view of an x-ray generation device of the third embodiment.

A third embodiment of the present invention is an x-ray generation device 3 whose perspective view is drawn in FIG. 3A. The x-ray generation device 3 comprises a cathode 31, an anode target 15, and a glass container 17. The difference between the x-ray generation devices 1, 3 is that the x-ray generation device 3 does not comprise a focusing device for focusing x-rays. Focusing x-rays is achieved by the cathode 31 instead.

Figure 3B:
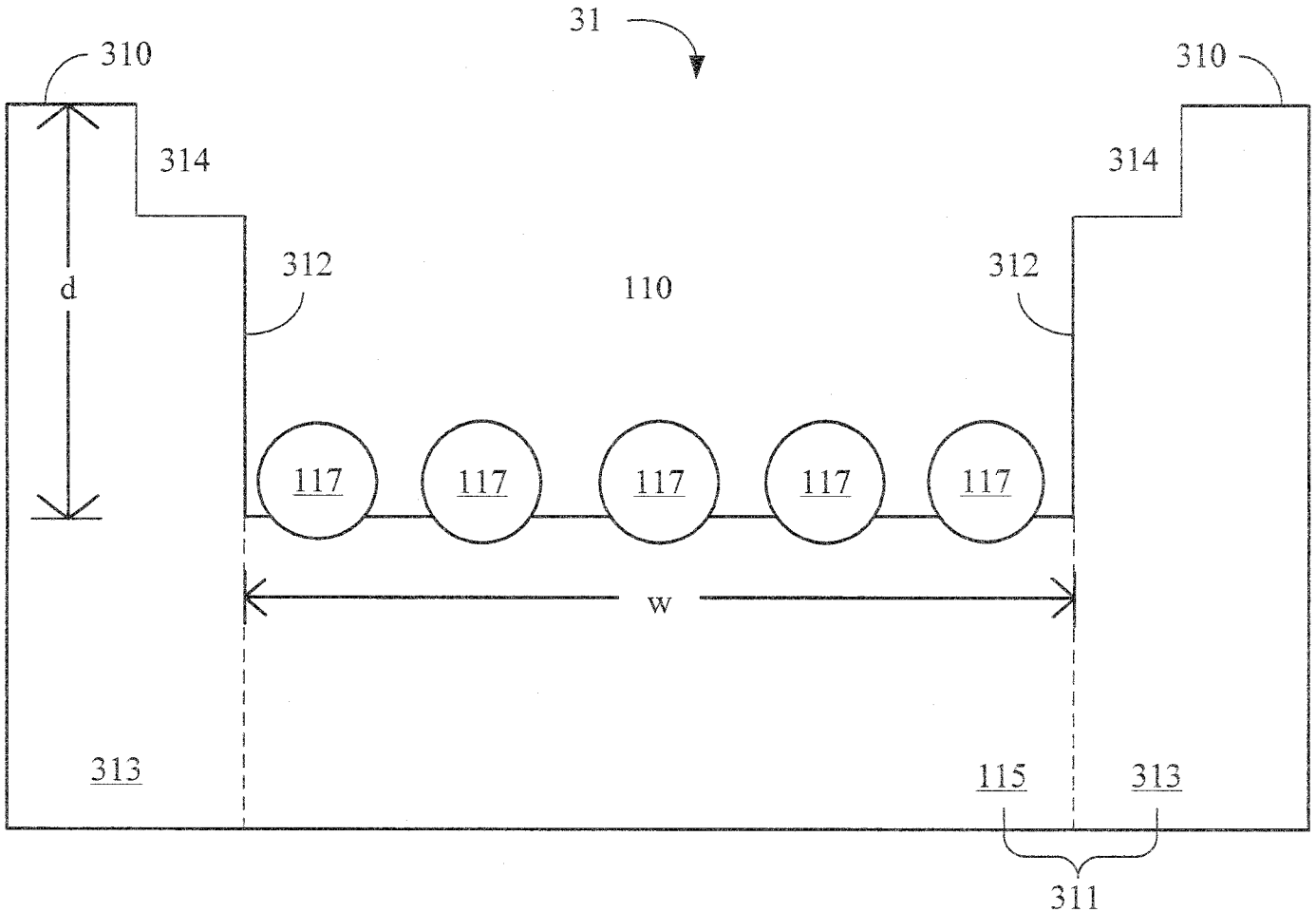
FIG. 3B is a sectional drawing of the cathode of the x-ray generation device of the third embodiment.

FIG. 3B is a sectional drawing of the cathode 31. The cathode 31 comprises a container 311 and an electron beam generator. The electron beam generator of the cathode 31 is similar to that of the cathode 11 in the first embodiment. In addition, the electron beam generator of the cathode 31 has many variations as those of the cathode 11. As the details are described in the first embodiment, they are not repeated here. The following descriptions are focused on difference between the containers 111, 311.

The container 311 has a base 115 and a side wall 313 surrounding the base 115, wherein the base 115 and the side wall 313 define a trench 110. The container 311 has a top surface 310 and the side wall 311 has an inner side 312. A breach 314 is formed at the top surface 310 of the container 311 and the inner side 312 of the side wall 313. By forming the breach 314, the x-rays are focused by the breach 314.

Although the x-ray focusing parts are different in the x-ray generation devices 1, 3, they have similar performances and advantages as the x-ray generation device 1.

Figure 4:
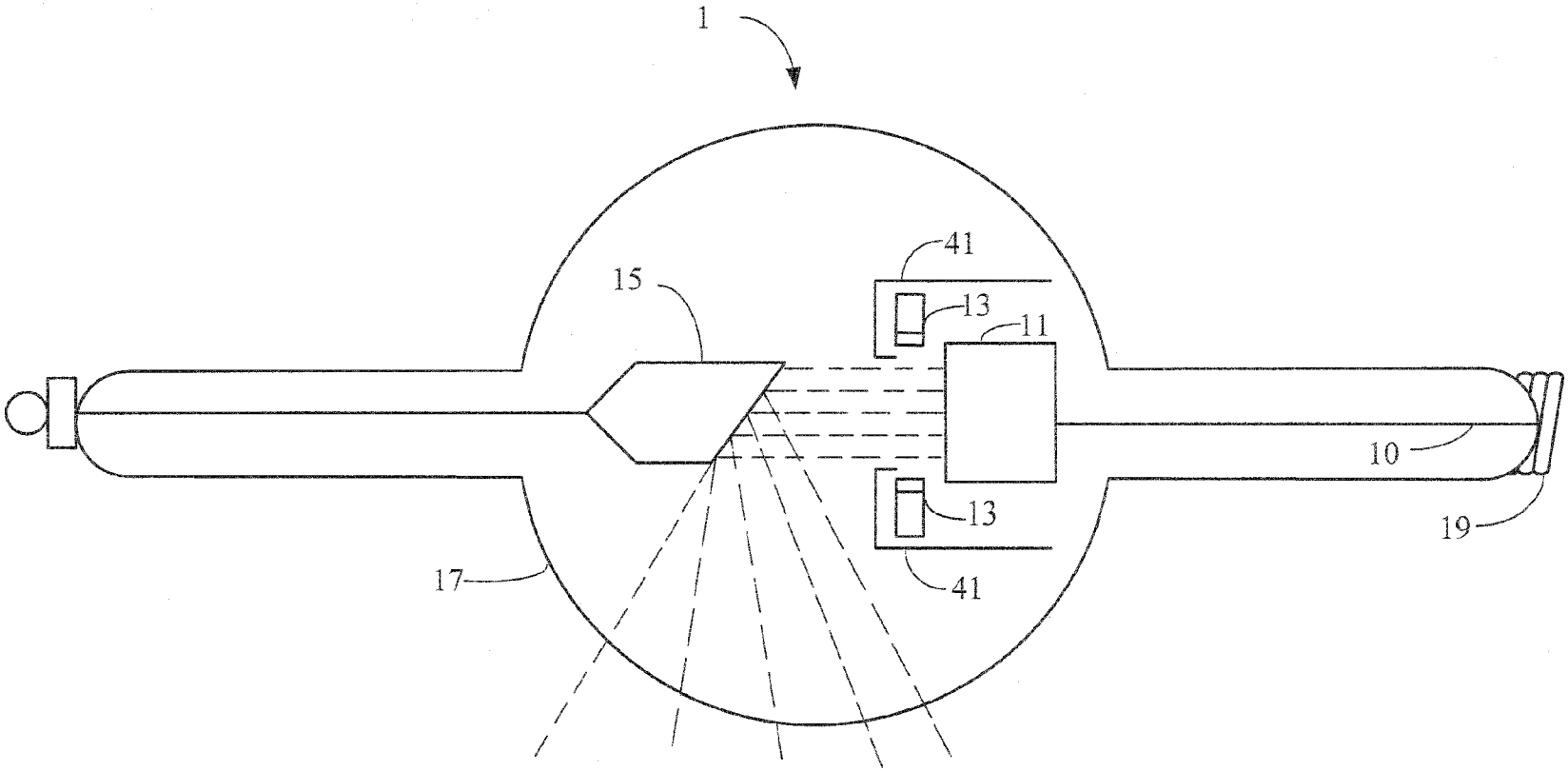
FIG. 4 illustrates a perspective view of an x-ray generation device of the fourth embodiment.

A forth embodiment of the present invention is an x-ray generation device 4, whose perspective view is drawn in FIG. 4. The x-ray generation device 4 also comprises a cathode 11, a focusing device 13, an anode target 15, a glass container 17 and an outer metal unit 19, and all of them perform similar functions as those described in the first embodiment and are not repeated here. The x-ray generation device 4 comprises a focusing cap 41 additionally. The focusing cap 41 is shaped like a cover and covers the cathode 11 and the focusing device 13. Particularly, the focusing cap 41 may be made of stainless steel.

Figure 5:
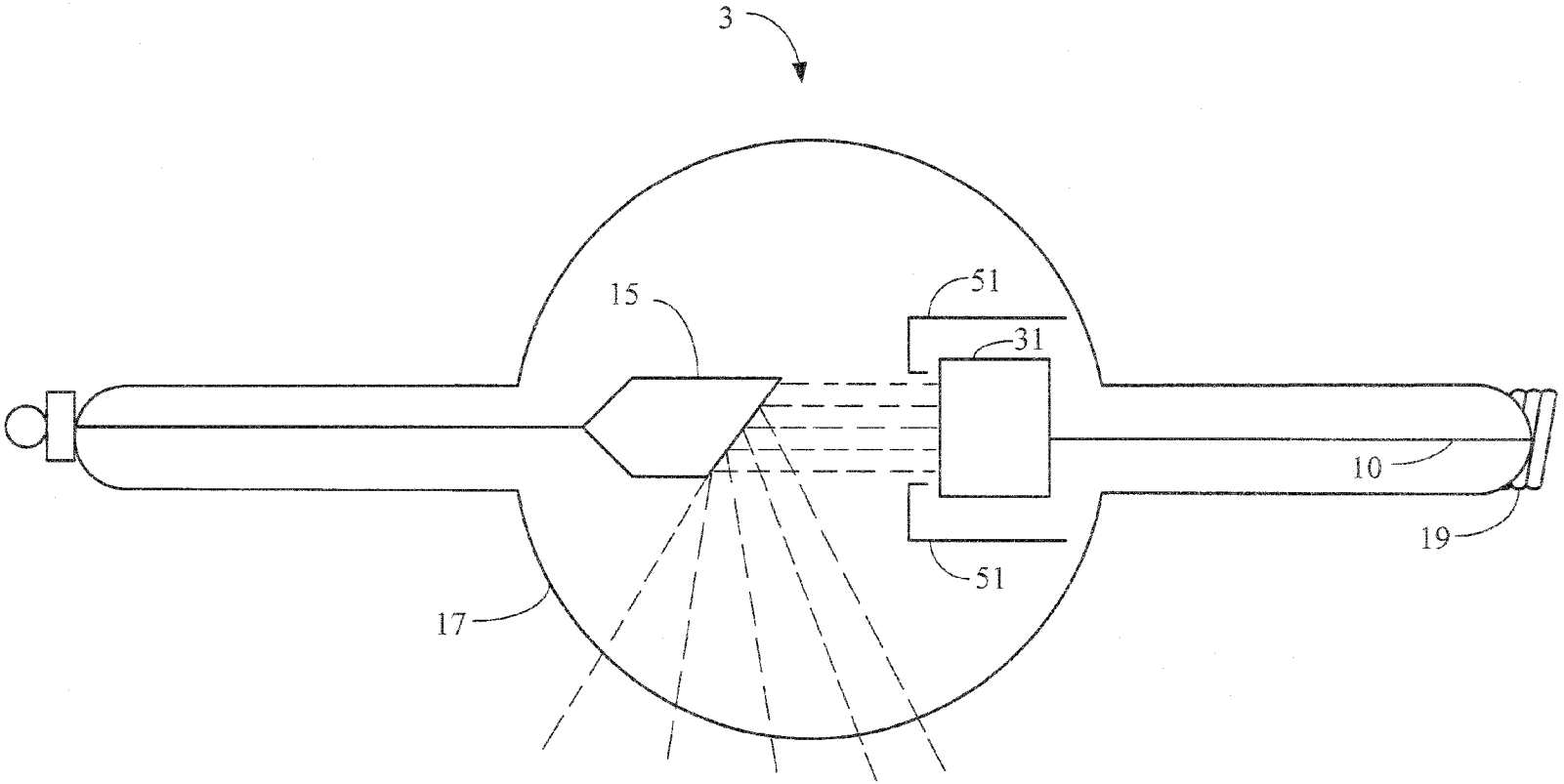
FIG. 5 illustrates a perspective view of an x-ray generation device of the fifth embodiment.

A fifth embodiment of the present invention is an x-ray generation device 5, whose perspective view is drawn in FIG. 5. The x-ray generation device 5 comprises a cathode 31, an anode target 15, and a glass container 17, and all of them perform similar functions as those described in the third embodiment and are not repeated here. The x-ray generation device 5 comprises a focusing cap 51 additionally. The focusing cap 51 is in the shape of a cover. Since the x-ray generation device 5 does not comprise a focusing device for focusing x-rays (which is achieved by the breach 314 of the cathode 31 instead), so the focusing cap only covers the cathode 31. Similarly, the focusing cap 51 may be made of stainless steel.

In summary, the x-ray generation device and the cathode thereof of the present invention outperform those in the prior art in terms of starting voltage and operating voltage. The outperformance comes from having each of the metal units of the electron beam generator chemical-vapor-deposited a carbon layer. Particularly, the x-ray generation device and the cathode thereof of the present invention can have better performance when the carbon layers are directly grown on the metal units and in the form of multiple-walls.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. An x-ray generation device, comprising:

a cathode having a base and a side wall forming a trench shaped container, a plurality of metal bars mounted on said base in said trench and each of said metal bars having a diameter between about 0.1 mm to 3 mm, wherein each of said metal bars have a carbon layer grown thereupon including an interlayer and an emission layer;

an anode target;

a glass chamber for housing said cathode, a focusing device, and said anode target in sequence;

wherein said x-ray generation device can be operated with a starting electric field 0.3 V/μm for generating an electron current density over 1 mA/cm$^2$ without using a gate voltage between said anode target and said cathode as its accelerating field.

2. The x-ray generation device of claim 1, wherein the x-ray generation device further comprises a hollow focusing cap as an electromagnetic lens disposed in front of said cathode so as to focus an electron beam emitted from said emission layer and emergent out through a hollow portion of said focusing cap.

3. The x-ray generation device of claim 2, wherein the material of the focusing cap is stainless steel.

4. The x-ray generation device of claim 3, wherein the material of said metal bars is selected from the group consisting of nickel, tungsten, and cobalt.

5. The x-ray generation device of claim 1, wherein the material of said metal bars is selected from the group consisting of nickel, tungsten, and cobalt.

6. The x-ray generation device of claim 1, wherein said carbon layer contains multi-wall nanotubes.

7. The x-ray generation device of claim 1, wherein a thickness of-said inter layer is between 10 nm and 60 nm and a thickness of said emission layer is between 1 nm and 50 nm.

8. An x-ray generation device, comprising:

a cathode having a base and a side wall about 5 mm to 10 mm in height forming a trench shaped container, a plurality of metal bars mounted in said trench and on said base and each of said metal bars having a diameter between about 0.1 mm to 3 mm, wherein each of said metal bars have a carbon layer grown thereupon including an interlayer and an emission layer, said emission layer having a multiwall morphology multiwall;

a hollow focusing cap as an electromagnetic lens disposed in front of said cathode so as to focus an electron beam emitted from said emission layer and emergent out through a hollow of said focusing cap;

an anode target;

a glass chamber for housing said cathode, said focusing device, and said anode target in sequence;

wherein said x-ray generation device has a feature that under conditions of a constant emission current density 1 mA/cm$^2$, and a distance between said anode target and said metal bars varied from 7 mm to 60 mm, an operating voltage is kept at a range between about 12 keV-13 keV.

9. The x-ray generation device of claim 8, wherein the material of the focusing cap is stainless steel.

10. The x-ray generation device of claim 8, wherein a thickness of said inter layer is between 10 nm and 60 nm and a thickness of said emission layer is between 1 nm and 50 nm.

* * * * *